US008296880B1

(12) United States Patent
Hennessy

(10) Patent No.: US 8,296,880 B1
(45) Date of Patent: Oct. 30, 2012

(54) HAMMOCK

(75) Inventor: Thomas F. Hennessy, Galiano Island (CA)

(73) Assignee: Hennessy Holdings, Ltd., Galiano Island (CA)

( * ) Notice: Subject to any disclaimer, the term of this patent is extended or adjusted under 35 U.S.C. 154(b) by 1092 days.

(21) Appl. No.: 11/748,910

(22) Filed: May 15, 2007

(51) Int. Cl.
*A45F 3/22* (2006.01)
*A45F 4/08* (2006.01)

(52) U.S. Cl. ..... 5/122; 5/120; 5/123

(58) Field of Classification Search ..... 5/120, 122
See application file for complete search history.

(56) References Cited

U.S. PATENT DOCUMENTS

| | | | | |
|---|---|---|---|---|
| 614,621 | A | 11/1898 | Palmer | |
| 1,077,229 | A | 10/1913 | Palmer | |
| 5,038,428 | A * | 8/1991 | Shur | 5/122 |
| 5,072,465 | A * | 12/1991 | Lyons, Jr. | 5/121 |
| 6,185,763 | B1 | 2/2001 | Hennessy | |
| 6,865,757 | B2 | 3/2005 | Hennessy | |

* cited by examiner

*Primary Examiner* — J. Liu
(74) *Attorney, Agent, or Firm* — Shoemaker and Mattare

(57) ABSTRACT

A hammock having a self-closing bottom entrance slit is constructed with the slit substantially offset to one side of the center line of the hammock. This improves comfort by enabling one to lie in the hammock out of contact with the slit, and facilitates the addition of an insulating panel to the hammock.

17 Claims, 5 Drawing Sheets

HAMMOCK

FIELD OF THE INVENTION

This invention relates to hammocks, particularly to a jungle hammock having a bottom entrance opening.

BACKGROUND OF THE INVENTION

For camping and other recreational activities, different hammocks have been developed to provide shelter from insects, ground dwelling creatures and inclement weather. Being suspended above the ground, hammocks provide a more comfortable, dry, warm and clean surface than do tents.

Traditional hammocks were entered by climbing over one side. That was difficult and sometimes dangerous, because the hammock was out of balance when a person entered it. The potential occupant pushed down one of the higher sides of the hammock, as low as possible, towards its longitudinal axis of symmetry, to gain access. As soon as the person sat down and his weight came off of his feet, the hammock swung back into its original position, tumbling the person backward, sometimes out of the hammock.

In my U.S. Pat. No. 6,185,763—the disclosure of which is incorporated herein by reference—I described a hammock which had a partial entrance slit running from one end of the hammock about half the hammock length, so that one could enter the hammock simply by standing up through the slit from directly beneath one end of the hammock, and then reclining on the unslit portion of the bed. The person's weight induced lengthwise tension in the fabric, which closed the slit so well that he or she could lie right on the slit and not fall out. I thought at the time that the slit must extend along the longitudinal center plane of the hammock, where the tension forces are the greatest.

My U.S. Pat. No. 6,865,757—which is also incorporated herein by reference—discloses a different hammock which is asymmetrical so as to encourage one to lie not along the tension axis established by the ropes at either end, as one does in most hammocks, but rather diagonally across the tension axis. This improves comfort by enabling one to lie diagonally across the tension axis.

I have combined the features of these two concepts, by making hammocks which have a bottom entrance slit and which are asymmetrical. These hammocks work as expected, but some users have reported that—particularly in asymmetrical versions where they lie diagonally to the longitudinal direction—lying across the tensioned slit is uncomfortable.

Knowing that fabric tension under load is the greatest along the center line of a hammock, I had thought that the slit would have to be centered in the hammock material for it to work; however, I have discovered that, when the occupant changes position from the longitudinal axis to lie on a diagonal axis, tension of the bottom fabric is spread over a wider area, allowing the entrance slit to remain under tension even when offset to one side of the longitudinal axis of the hammock. Moreover, the offset slit will remain closed under tension against all but deliberate opening maneuvers.

SUMMARY OF THE INVENTION

An object of this invention is to improve the comfort of a hammock having a bottom entrance slit.

This and other objects of the invention will be apparent from the drawings and the following description, augmented by the description contained in U.S. Pat. No. 6,185,763, which is incorporated by reference herein.

DESCRIPTION OF THE PREFERRED EMBODIMENT

Figure 1:
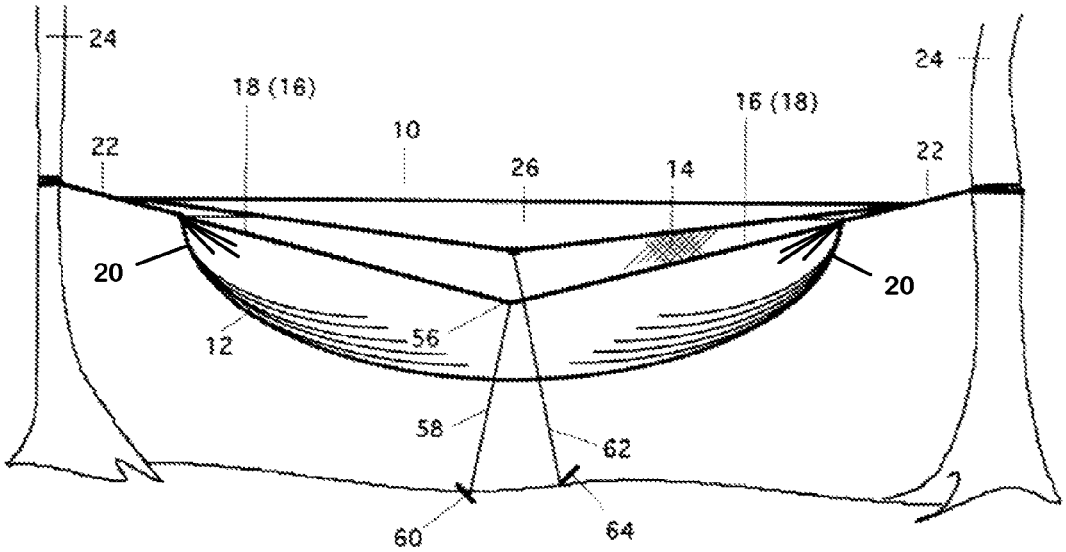
FIG. 1 (PRIOR ART)
FIG. 1 is a perspective view of a hammock having an entrance slit which bisects the hammock fabric and extends along the tension axis as shown in my U.S. Pat. No. 6,185,763.

A hammock 10 embodying the invention comprises a bed 12, an insect net 14 which is located above the bed and is attached along its edges 16 to longitudinal sides 18 of the bed. Each end 20 of the bed is connected by a suspending rope 22 to one of a pair of spaced anchors 24 such as trees.

A canopy 26 overhangs the insect net 14. Cords 58, 62 extending from the midpoint 56 of the bed and canopy, respectively, may be tied to anchors 60, 64 to keep the bed and canopy spread out.

The bed 12, dimensioned to provide accommodation for one or more persons, is made from a substantially rectangular sheet 28 (see FIG. 2) of flexible breathable material. It must be of sufficient strength and resilience to withstand an appropriate load and repeated use under varying conditions. Nylon, polyester or a synthetic fabric with similar qualities is used.

An entrance slit 30 extends from one of the short sides 32 of a substantially rectangular sheet 28 for about half the length of the bed. The short sides 32 of the rectangular sheet 28 are folded several times parallel to the longitudinal axis "T" of sheet 28. This gathering of the bed material is described in detail in U.S. Pat. No. 6,185,763.

To enter the hammock, a person crouches or stoops so that he is directly below the hammock slit, and then stands up through the slit, either entering head first and turning around inside the hammock, or backing in until the back of his knees contact the low end of entrance slit 30. Then, the person sits down on the unslit portion of the bed 12, which tensions the sheet 28, particularly the lengthwise (warp) threads.

As the person reclines against the bed 12, lifting the legs off the ground, his entire weight is supported by tension in the fabric. Consequence, as the occupant lifts his legs through entrance slit 30, the slit snaps close under tension, providing secure support and a bug-proof environment.

Figure 2:
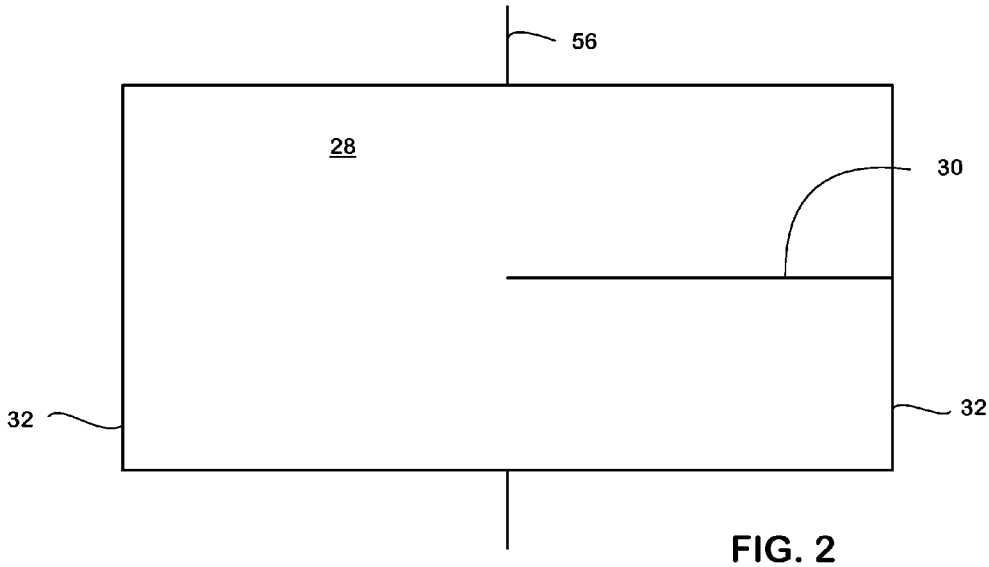
FIG. 2 (PRIOR ART)
FIG. 2 is a laid-out view of the fabric portion of the symmetrical FIG. 1 hammock, showing the centered location of the entrance slit.
Figure 3:
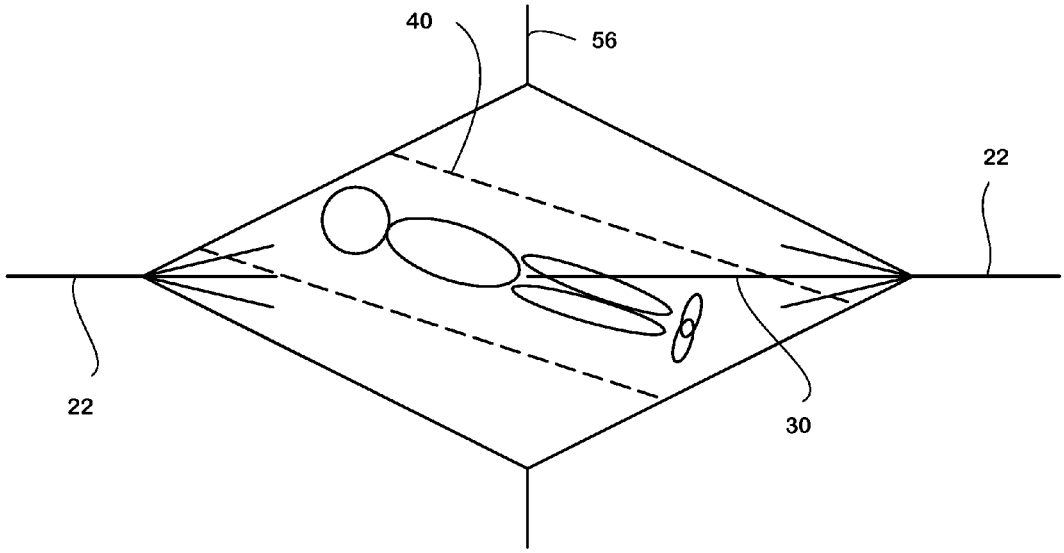
FIG. 3 (PRIOR ART)
FIG. 3 is a top plan view thereof, showing the ends gathered and attached to suspending ropes, with a person lying diagonally across the entrance slit.
Figure 4:
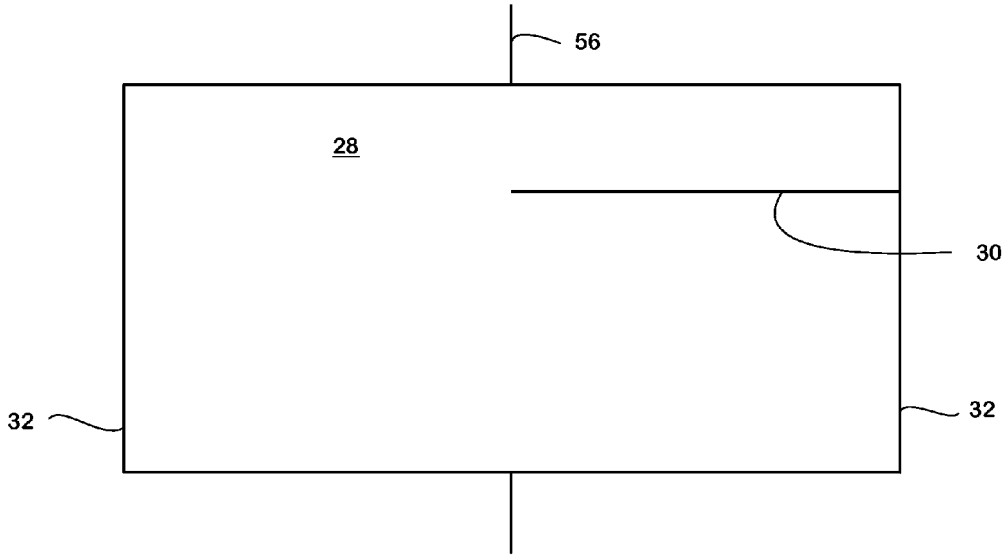
FIG. 4 is a laid-out view of a the fabric portion of a symmetrical hammock according to the present invention, showing a laterally offset entrance slit.

FIGS. 1-3 are labeled "PRIOR ART" because the entrance slit in each of them is centered on the fabric and extends along the tension axis "T" of the hammock, as taught by U.S. Pat. No. 6,185,763. The improvement provided by the present invention is depicted in FIGS. 4-7. Because the ends of the hammock fabric are gathered, in FIG. 4 the slit appears to extend at an angle to the axis "T", but as one can see in the layout of FIG. 5, actually it is cut parallel to, but laterally offset from, the axis "T". Preferably, the slit lies to one side of at least 60% of the width "W" of the fabric, more preferably 60%-80%, most preferably about 70%.

Figure 6:
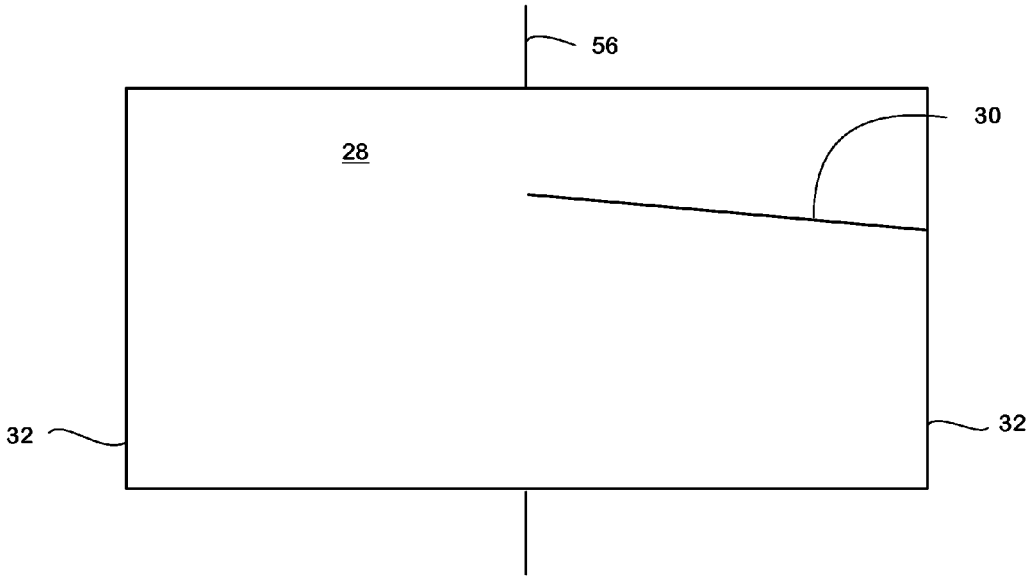
FIG. 6 is a laid-out view of the fabric portion of a modified form of the invention, wherein the slit extends on a bias angle to the length of a symmetrical hammock.
Figure 7:
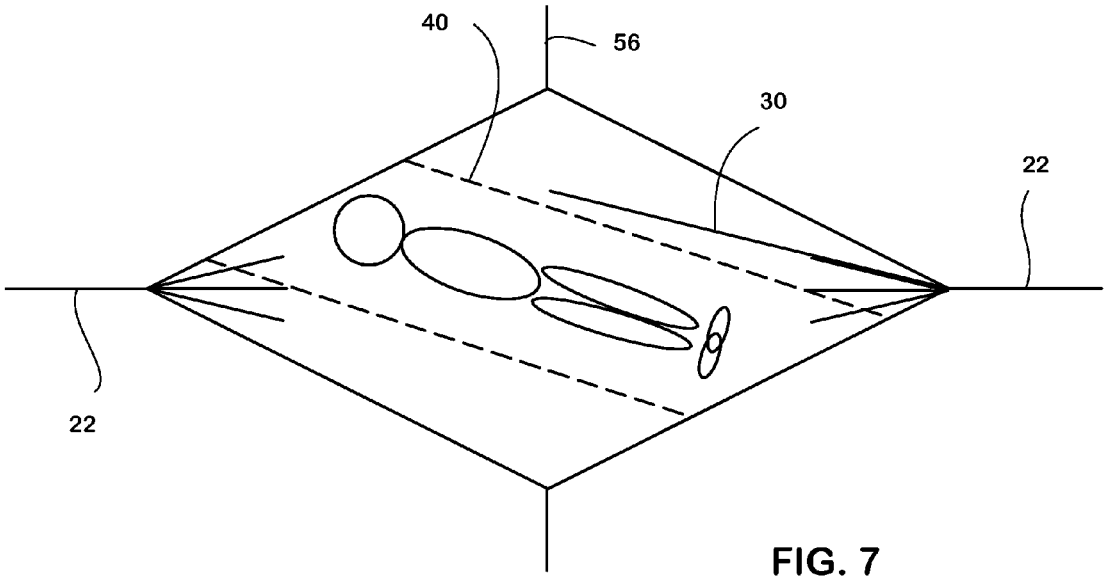
FIG. 7 is a top plan view thereof, showing the ends of the fabric gathered and attached to suspending ropes, with a person lying diagonally on the symmetrical hammock but not across the entrance slit.

In the example of FIGS. 6 and 7, the slit actually is cut at a bias, diagonally with respect to the tension axis and the warp threads of the fabric. The edges of the slit may have to be reinforced in this example to prevent fraying of the fabric edge. The slit in FIG. 6 is shown to be offset to one side of the center line a substantial amount; however, the amount of offset may vary.

Figure 8:
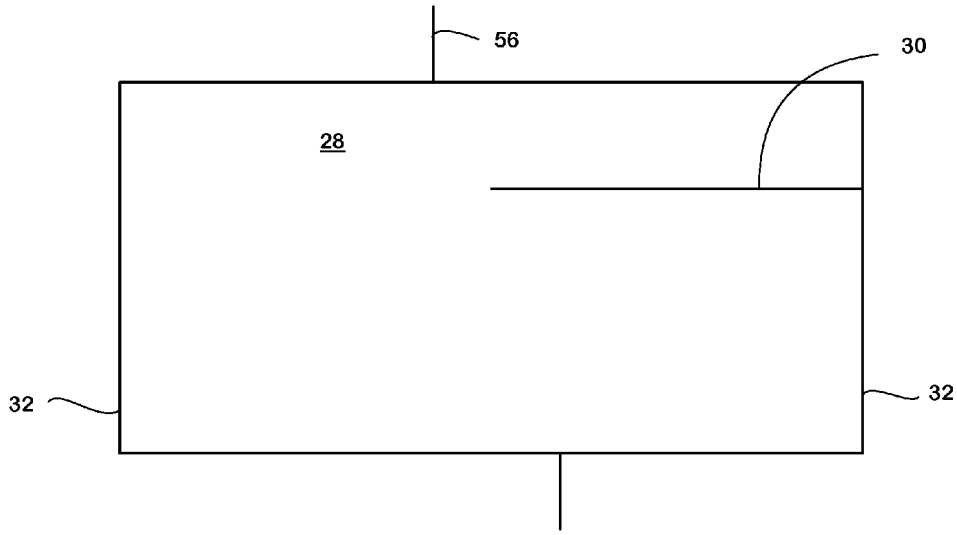
FIG. 8 is a laid out view of the fabric portion of an asymmetrical hammock embodying the invention.
Figure 9:
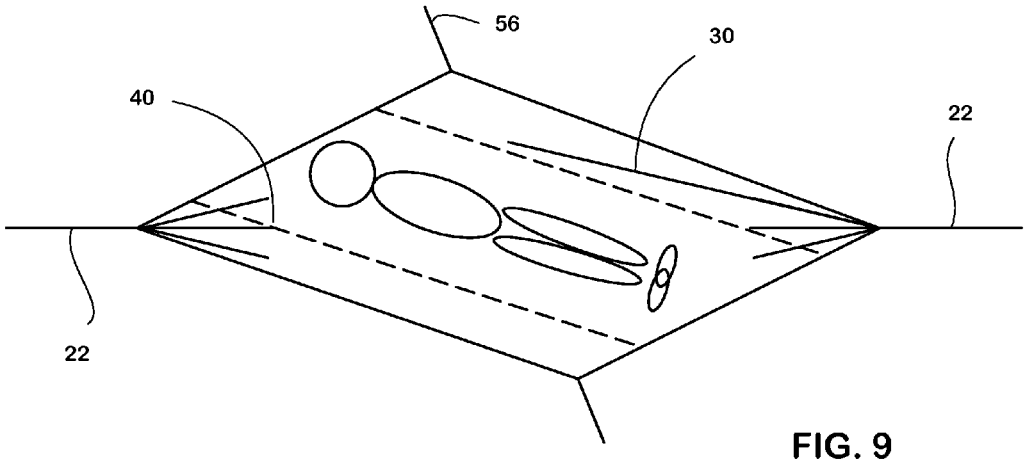
FIG. 9 is a top plan view thereof, showing a person lying diagonally on the asymmetrical hammock.

FIGS. 8 and 9 show the principles of the invention applied to an asymmetrical hammock. The hammock is termed asymmetrical because, if folded in the tension axis "T", its sides are not aligned with one another. The asymmetrical shape encourages an occupant to lie diagonally across the tension axis, which provides good support for the lower back. In this case, the slit is offset to the side away from the natural position of the user's legs.

Figure 5:
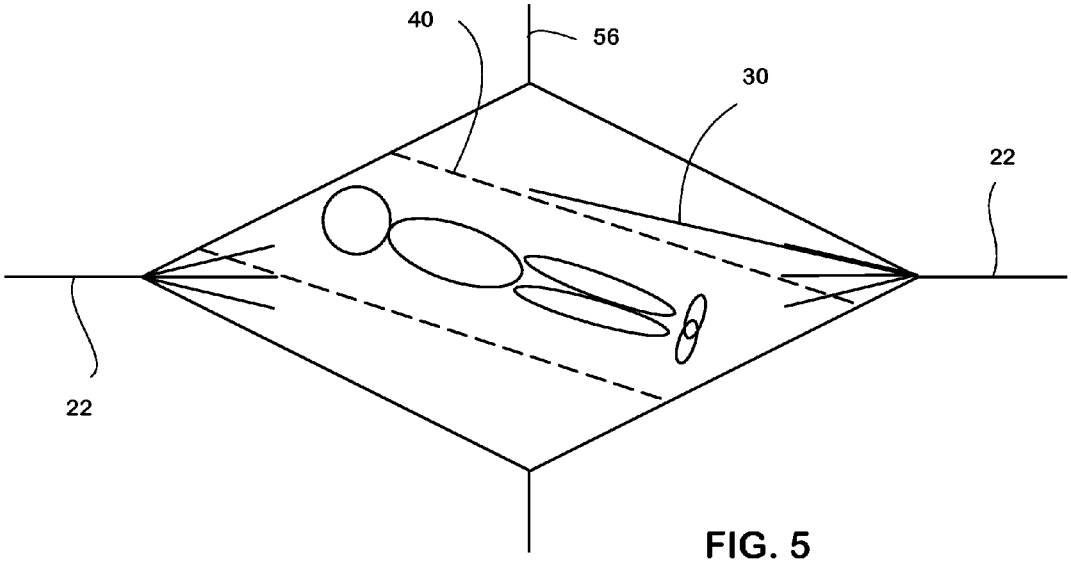
FIG. 5 is a top plan view of thereof, again showing the ends gathered and attached to suspending ropes, with a person lying diagonally on the symmetrical hammock but not across the entrance slit.

One advantage of the invention is that, as FIGS. 5, 7 and 9 show, a person can lie on the hammock with improved comfort out of contact with the tensioned entrance slit. Another advantage is that an insulation panel 40, if desired, can be installed diagonally across the bottom of the hammock, beneath the expected user location, without crossing the entrance slit. Both construction and use of an insulated version of the hammock are thus simplified: the insulation panel does not have to have a slit in it, and the user does not have to negotiate an opening in the insulation.

Although the hammock has been described above as being made of a woven fabric material, it should be understood that the inventive aspects do not depend on the nature of the material and thus the claims below refer to a "sheet" of material. The material could alternatively be a non-woven fibrous material, a film, foil or other thin, strong and preferably breathable material perhaps yet to be invented.

Inasmuch as the invention is subject to many variations and modifications, it is intended that the description and drawings shall be interpreted as merely examples of the invention defined by the claims below.

I claim:

1. A hammock comprising a bed made of a piece of fabric material gathered at opposite ends and joined at each said end to a suspension rope, said fabric having a entrance slit running from one of said ends for about half the length of the bed, said entrance slit being non-coextensive with a longitudinal axis bisecting said fabric.

2. The invention of claim 1, wherein the entrance slit is offset sufficiently to one side of the material so that the entrance slit does not lie under the occupant and does not interfere with installation of an insulation panel beneath the occupant.

3. The invention of claim 1, wherein 60%-80% of the width of the material is to one side of said entrance slit.

4. The invention of claim 1, wherein the material is a woven fabric having warp threads running between said opposite ends and the entrance slit is parallel to the warp threads.

5. The invention of claim 1, wherein the fabric has warp threads running between said opposite ends and the entrance slit cuts diagonally across some of said warp threads, from one end of the fabric, in a direction toward one lateral edge of the fabric.

6. The invention of claim 1, wherein the hammock fabric has a shape which is asymmetric about a line extending between said opposite ends.

7. The invention of claim 1, wherein the entrance slit is parallel to the longitudinal axis of the hammock.

8. The invention of claim 1, wherein the entrance slit extends diagonally with respect to the longitudinal axis of the hammock.

9. In a hammock of the type comprising a bed comprising a piece of fabric, said fabric being gathered at opposite ends, each gathered end being secured to a rope which can be tied to a tree, said fabric having a longitudinal direction extending between said gathered ends, an entrance slit formed in the fabric running from one end of the fabric for about half the length of the bed, whereby, once the hammock is attached to a pair of trees, a person can enter the hammock from below by standing up through the slit and then reclining on an unslit portion of the fabric, the entrance slit thereupon being closed by tension in the fabric resulting from the weight of the person thereon, the improvement wherein the entrance slit is offset laterally from the longitudinal center plane of the hammock so that a person need not lie on or across the slit.

10. The invention of claim 9, wherein the entrance slit is offset sufficiently to one side of the material so that the entrance slit does not lie under the occupant and does not interfere with installation of an insulation panel beneath the occupant.

11. The invention of claim 9, wherein 60%-80% of the width of the fabric is to one side of said entrance slit.

12. The invention of claim 9, wherein the fabric has warp threads running between said opposite ends and the entrance slit is parallel to the warp threads.

13. The invention of claim 9, wherein the fabric has warp threads running between said opposite ends and the entrance slit cuts diagonally across some of said warp threads, from one end of the fabric, in a direction toward the lateral edge of the fabric nearer the entrance slit.

14. The invention of claim 9, wherein the hammock fabric has a shape which is asymmetric about a line extending between said opposite ends.

15. The invention of claim 9, further comprising an insulation panel attached to the hammock fabric and extending diagonally across the fabric with respect to the longitudinal axis without crossing the entrance slit.

16. The invention of claim 9, wherein the entrance slit is parallel to the longitudinal axis of the hammock.

17. The invention of claim 9, wherein the entrance slit extends diagonally with respect to the longitudinal axis of the hammock.

* * * * *